US005595828A

United States Patent [19]

Weber et al.

[11] Patent Number: 5,595,828

[45] Date of Patent: Jan. 21, 1997

[54] POLYMER-REINFORCED, EUCALYPTUS FIBER-CONTAINING PAPER

[75] Inventors: Robert E. Weber, Marietta; Linda G. Harris, Lawrenceville; Amy B. Reed, Marietta, all of Ga.

[73] Assignee: Kimberly-Clark Corporation, Neenah, Wis.

[21] Appl. No.: 451,590

[22] Filed: May 26, 1995

Related U.S. Application Data

[62] Division of Ser. No. 346,665, Nov. 30, 1994.

[51] Int. Cl.[6] ..... D21H 21/22; D21H 11/00; B32B 29/00; D21F 11/00

[52] U.S. Cl. ..... 428/537.5; 428/153; 428/339; 428/340; 428/341; 428/360; 428/362; 428/364; 428/365; 428/369; 162/157.6; 162/164.1; 162/164.5; 162/164.6; 162/164.7; 162/165; 162/166; 162/167; 162/168.2

[58] Field of Search ..... 428/153, 339, 428/340, 341, 359, 360, 362, 364, 365, 369, 537.5; 162/157.6, 164.1, 164.5, 164.6, 164.7, 165, 166, 167, 168.2

[56] References Cited

U.S. PATENT DOCUMENTS

| | | | |
|---|---|---|---|
| 4,018,647 | 4/1977 | Wietsma | 162/168 |
| 4,634,499 | 1/1987 | Ampulski | 162/84 |
| 4,734,162 | 3/1988 | Ampulski | 162/84 |
| 4,781,793 | 11/1988 | Halme | 162/55 |
| 4,966,651 | 10/1990 | Olson et al. | 162/28 |
| 5,129,988 | 7/1992 | Farrington, Jr. | 162/123 |
| 5,164,045 | 11/1992 | Awofeso et al. | 162/101 |

FOREIGN PATENT DOCUMENTS

| | | |
|---|---|---|
| 2076615 | 10/1993 | Canada . |
| 1329072 | 5/1994 | Canada . |
| 3631835 | 12/1988 | Germany . |
| 57-082597 | 5/1982 | Japan . |
| 2293497 | 12/1990 | Japan . |
| 3222314 | 10/1991 | Japan . |
| 4015021 | 1/1992 | Japan . |
| 61-23095 | 5/1994 | Japan . |
| 61-28895 | 5/1994 | Japan . |
| 61-36687 | 5/1994 | Japan . |
| 61-46193 | 5/1994 | Japan . |
| 61-46195 | 5/1994 | Japan . |
| 697623 | 11/1979 | U.S.S.R. . |
| 89/03268 | 4/1989 | WIPO . |
| 89/06718 | 7/1989 | WIPO . |

*Primary Examiner*—Patrick Ryan
*Assistant Examiner*—Richard C. Weisberger
*Attorney, Agent, or Firm*—William E. Maycock

[57] ABSTRACT

An improved-strength, polymer-reinforced paper which includes fibers, of which at least about 30 percent on a dry weight basis are eucalyptus fibers; and from about 15 to about 60 percent by weight, based on the dry weight of the fibers, of a latex binder.

11 Claims, 4 Drawing Sheets

POLYMER-REINFORCED, EUCALYPTUS FIBER-CONTAINING PAPER

This application is a division of Ser. No. 08/346,665 entitled "A POLYMER-REINFORCED, EUCALYPTUS FIBER-CONTAINING PAPER" and filed in the U.S. Patent and Trademark Office on Nov. 30, 1994, pending.

BACKGROUND OF THE INVENTION

The present invention relates to a polymer-reinforced paper in which the reinforcing polymer is a latex.

It generally is understood that the properties of paper depend largely on the structure of the various fibers that compose the sheet. The two most important structural characteristics are fiber length and cell wall thickness. A minimum length is required for interfiber bonding and length is virtually proportional to tear strength.

Because softwood fibers typically are from about two to about five times longer than hardwood fibers, the former are universally more desired for papermaking. A papermaking stock or furnish also may contain hardwood fibers, but they are present primarily to improve sheet smoothness and formation, e.g., a uniform distribution of fibers in the paper. In fact, the presence of more than minor amounts of hardwood fibers often has a deleterious effect on the strength and tear resistance of the resulting paper. The more common hardwoods employed as a source of fibers include aspen, birch, beech, oak, maple, and gum.

Although not commonly used, eucalyptus (a hardwood) fibers have been employed in paper and paper-related products. For example, a paper reportedly was made from pulp containing from 0.5 to 20 weight percent fine fibrous cellulosic material having an average fiber length of 0.01 mm to 0.4 mm and at least 20 weight percent of pulp made from eucalyptus wood. Other eucalyptus fiber-containing papers also have been reported. Papers made from bleached eucalyptus kraft pulp have been impregnated with a phenolic resin and employed in the manufacture of printed circuit boards. Eucalyptus fibers also have been employed in the manufacture of tissue, including a layered tissue and a tissue impregnated with an oily material. An electrolysis paper containing at least 20 weight percent eucalyptus pulp located between an anode foil and a cathode foil in an electrolytic capacitor has been described. A hard fiberboard material comprising eucalyptus wood has been employed in the manufacture of a high-pressure laminate. A paper web made of poplar or eucalyptus wood and pine wood in a ratio of from 15:85 to 85:15 was coated with a surface layer consisting of a substantially hygroscopic additive. Finally, paper strips based on eucalyptus and pinewood sulphate-cellulose in the ratio of from 50:50 to 10:90 were impregnated with mixtures of aqueous anionic copolymer solutions and dispersions, followed by further surface treatments.

A long-established practice for improving the strength characteristics and durability of a paper involves reinforcement of the paper by polymer impregnation. The polymer employed typically is a synthetic material, and the paper consists primarily of long softwood cellulosic fibers or of a mixture of softwood cellulosic and noncellulosic fibers. Polymer reinforcement is employed to improve one or more of such properties as dimensional stability, resistance to chemical and environmental degradation, resistance to tearing, embossability, resiliency, conformability, moisture and vapor transmission, and abrasion resistance, among others.

In general, the property or properties which are desired to be improved through the use of a polymer-reinforced paper depend on the application. For example, the resistance of a paper to tearing is particularly important when the paper is to be used as a base for masking papers and tapes, abrasive papers for machine sanding, and flexible, tear-resistant marking labels, by way of illustration only. Although strength is a primary attribute, smoothness and good formation also are desired. While significant advances have been made in the improvement of smoothness and formation, opportunities still remain for further improvements in smoothness and sheet formation without sacrificing, or even with improvements in, the strength of papers.

SUMMARY OF THE INVENTION

The present invention addresses some of the difficulties and problems discussed above by providing an improved-strength, polymer-reinforced paper which includes fibers, of which at least about 30 percent on a dry weight basis are eucalyptus fibers, and from about 15 to about 60 percent by weight, based on the dry weight of the fibers, of a latex binder. When fibers other than eucalyptus fibers are present, such other fibers may be cellulosic fibers, mineral fibers, synthetic fibers, or mixtures thereof. If used, mineral and synthetic fibers typically will be present at levels in a range of from about 5 to about 25 percent on a dry weight basis.

Non-eucalyptus cellulosic fibers include softwood fibers and hardwood fibers. Examples of softwoods include, by way of illustration only, longleaf pine, shortleaf pine, loblolly pine, slash pine, Southern pine, black spruce, white spruce, jack pine, balsam fir, douglas fir, western hemlock, redwood, and red cedar. Examples of hardwoods other than eucalyptus include, again by way of illustration only, aspen, birch, beech, oak, maple and gum.

The present invention contemplates the inclusion, if desired, of minor amounts of cellulosic fibers other than those derived from hardwoods and softwoods; such fibers typically will be present at levels less than about 25 percent by weight, based on the total weight of fibers. These other cellulosic fibers include, for example, fibers from straws and grasses, such as rice, esparto, wheat, rye, and sabai; canes and reeds, such as bagasse; bamboos; woody stalks, such as jute, flax, kenaf, and cannabis; bast, such as linen and ramie; leaves, such as abaca and sisal; and seeds, such as cotton and cotton linters.

As already noted, the polymer-reinforced paper of the present invention includes from about 15 to about 60 percent by weight, based on the dry weight of the fibers, of a latex binder. Any of the latex binders commonly employed for reinforcing paper can be utilized and are well known to those having ordinary skill in the art. Such binders include, by way of illustration only, polyacrylates, including polymethacrylates, poly(acrylic acid), poly(methacrylic acid), and copolymers of the various acrylate and methacrylate esters and the free acids; styrene-butadiene copolymers; ethylene-vinyl acetate copolymers; nitrile rubbers or acrylonitrile-butadiene copolymers; poly(vinyl chloride); poly(vinyl acetate); ethylene-acrylate copolymers; vinyl acetate-acrylate copolymers; neoprene rubbers or trans-1,4-polychloroprenes; cis- 1,4-polyisoprenes; butadiene rubbers or cis-and trans-1,4-polybutadienes; and ethylene-propylene copolymers.

DETAILED DESCRIPTION OF THE INVENTION

Figure 1:
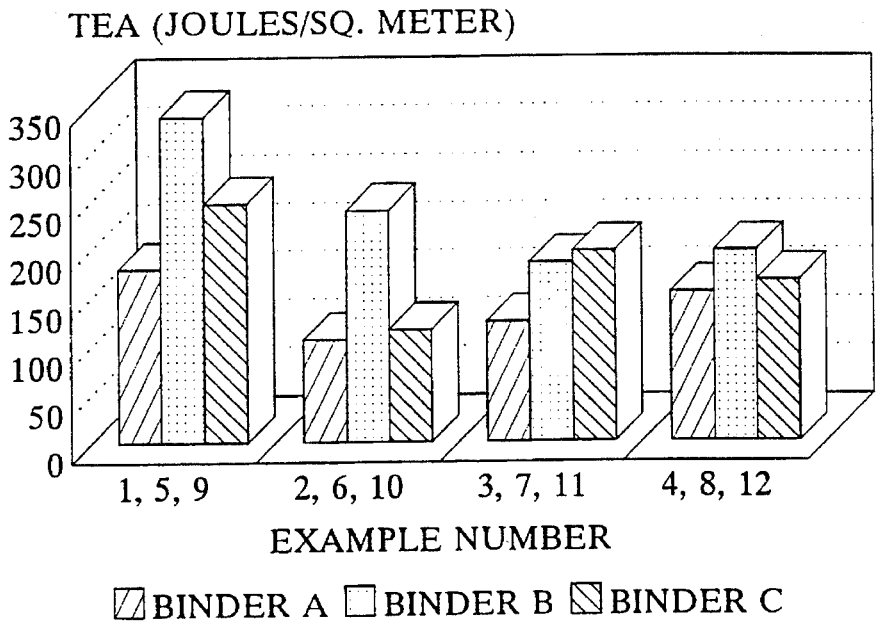
FIGS. 1–6 are three-dimensional bar graphs comparing a particular strength characteristic for various polymer-reinforced papers.

As used herein, such terms as "strength" and "strength characteristics" as applied to the polymer-reinforced paper of the present invention have reference primarily to tensile energy absorption, percent elongation at break, and tear.

The term "tensile energy absorption" or "TEA" refers to the average results of TEA tests as measured in accordance with TAPPI Method T494 and TAPPI test conditions, TAPPI Method T402.

The term "percent elongation at break" is determined in accordance with TAPPI Method T494 and refers to the percent elongation of the paper when the tensile strength of the paper has been reduced to 25 percent of its maximum tensile strength.

The term "tear" refers to the average result of tear tests as measured with an Elmendorf Tear Tester in accordance with TAPPI Method T414 and under TAPPI Method T402 conditions to control the moisture content of the paper being tested. The device determines the average force in newtons required to tear paper after the tear has been started. Thus, the term is a measure of the resistance of a paper to tearing.

Two of the three tests, i.e., TEA and percent elongation at break, were measured using an Instron Model 1122 Testing Machine (Instron Corporation) Canton, Mass. and TAPPI test conditions, Method T402.

"Tensile index" is used herein to mean the quotient of tensile strength divided by basis weight. Tensile strength is determined in accordance with TAPPI Method T494.

The expression "on a dry weight basis" and variations thereof refer to weights of fibers, e.g., eucalyptus fibers, or other materials which are essentially free of water in accordance with standard practice in the papermaking art. When used, such expressions mean that weights were calculated as though no water were present.

The improved-strength, polymer-reinforced paper of the present invention is prepared from fibers, of which at least about 30 percent on a dry weight basis are eucalyptus fibers. Thus, the paper may be prepared from eucalyptus fibers alone, or from a mixture of eucalyptus fibers and other fibers (non-eucalyptus fibers). The level of eucalyptus fibers employed primarily will be a function of the properties desired in the polymer-reinforced paper. For example, the eucalyptus fibers may be present at a level of at least about fifty percent on a dry weight basis. In another example, the eucalyptus fibers may be present in a range of from about 40 to about 75 percent by weight. In still another example, the eucalyptus fibers may be present in a range of from about 60 to about 80 percent by weight.

When fibers other than eucalyptus fibers are present, such other fibers may be cellulosic fibers, synthetic fibers, mineral fibers, or a mixture thereof. Non-eucalyptus cellulosic fibers include softwood fibers and hardwood fibers. Examples of softwoods include, by way of illustration only, longleaf pine, shortleaf pine, loblolly pine, slash pine. Southern pine, black spruce, white spruce, jack pine, balsam fir, douglas fir, western hemlock, redwood, and red cedar. Examples of hardwoods other than eucalyptus include, again by way of illustration only, aspen, birch, beech, oak, maple, and gum. If used, mineral and synthetic fibers typically will be present at levels in a range of from about 5 to about 25 percent on a dry weight basis.

The present invention contemplates the inclusion, if desired, of minor amounts of cellulosic fibers other than those derived from hardwoods and softwoods; such fibers typically will be present at levels less than about 25 percent by weight, based on the total weight of fibers. These other cellulosic fibers include, for example, fibers from straws and grasses, such as rice, esparto, wheat, rye, and sabai; canes and reeds, such as bagasse; bamboos; woody stalks, such as jute, flax, kenaf, and cannabis; bast, such as linen and ramie; leaves, such as abaca and sisal; and seeds, such as cotton and cotton linters.

Noncellulosic fibers such as mineral and synthetic fibers may be included, if desired. Examples of noncellulosic fibers include, by way of illustration only, glass wool and fibers prepared from thermosetting and thermoplastic polymers, as is well known to those having ordinary skill in the art.

The polymer-reinforced paper of the present invention also includes from about 15 to about 60 percent by weight, based on the dry weight of the fibers, of a latex binder. Any of the latex binders commonly employed for reinforcing paper can be utilized and are well known to those having ordinary skill in the art. Such binders include, by way of illustration only, polyacrylates, including polymethacrylates, poly(acrylic acid), poly(methacrylic acid), and copolymers of the various acrylate and methacrylate esters and the free acids; styrene-butadiene copolymers; ethylene-vinyl acetate copolymers; nitrile rubbers or acrylonitrile-butadiene copolymers; poly(vinyl chloride); poly(vinyl acetate); ethylene-acrylate copolymers; vinyl acetate-acrylate copolymers;neoprene rubbers or trans-1,4-polychloroprenes; cis.-1,4-polyisoprenes; butadiene rubbers or cis-and trans-1,4-polybutadienes; and ethylene-propylene copolymers.

Any of a number of commercially available latex binders may be used, some examples of which are summarized in Table 1, below.

TABLE 1

Suitable Latexes for Polymer-Reinforced Paper

| Polymer Type | Product Identification |
|---|---|
| Polyacrylates | Hycar ® 26083, 26084, 26120, 26104, 26106, 26322, 26469<br>B. F. Goodrich Company<br>Cleveland, Ohio<br>Rhoplex ® HA-8, HA-12, HA-16, NW-1715, B-15<br>Rohm and Haas Company<br>Philadelphia, Pennsylvania<br>Carboset ® XL-52<br>B. F. Goodrich Company<br>Cleveland, Ohio |
| Styrene-butadiene copolymers | Butofan ® 4264, 4262<br>BASF Corporation<br>Sarnia, Ontario, Canada<br>DL-219, DL-283<br>Dow Chemical Company<br>Midland, Michigan |
| Nitrile rubbers | Hycar ® 1572, 1577, 1570X55, 1562X28<br>B. F. Goodrich Company<br>Cleveland, Ohio |
| Poly(vinyl chloride) | Vycar ® 352, 552<br>B. F. Goodrich Company<br>Cleveland, Ohio |
| Ethylene-acrylate copolymers | Michem ® Prime 4990 |

TABLE 1-continued

| Suitable Latexes for Polymer-Reinforced Paper | |
|---|---|
| Polymer Type | Product Identification |
| | Michelman, Inc.<br>Cincinnati, Ohio<br>Adcote 56220<br>Morton Thiokol, Inc.<br>Chicago, Illinois |
| Vinyl acetate-acrylate copolymers | Xlink 2833<br>National Starch & Chemical Co.<br>Bridgewater, New Jersey |

The impregnating dispersion typically also will contain clay and an opacifier such as titanium dioxide. Typically, amounts of these two materials may range up to about 50 parts per 100 parts of polymer on a dry weight basis. Of course, the impregnating dispersion also can contain other materials, as described hereinafter.

The amount of binder added to the paper, on a dry weight basis, typically will be in the range of from about 15 to about 60 percent, based on the dry weight of the paper. The amount of binder added, as well as the basis weight of the paper before and after impregnation, in general are determined by the application intended for the polymer-reinforced paper.

In addition to fibers and binder, other materials may be present as is well known in the papermaking art. For example, the paper may contain acids and bases to control pH, such as hydrochloric acid, sulfuric acid, acetic acid, oxalic acid, phosphoric acid, phosphorous acid, sodium hydroxide, potassium hydroxide, ammonium hydroxide or ammonia, sodium carbonate, sodium bicarbonate, sodium dihydrogen phosphate, disodium hydrogen phosphate, and trisodium phosphate; alum; wet-strength resins, such as malamine-formaldehyde resins and cationic polyacrylamides; sizing agents, such as rosin and wax; dry strength adhesives, such as natural and chemically modified starches and gums; cellulose derivatives such as carboxymethyl cellulose, methyl cellulose, and hemicellulose; synthetic polymers, such as phenolics, lattices, polyamines, and polyacrylamides; wet strength resins, such as urea-formaldehyde resins, melamine-formaldehyde resins, and polyamides; fillers, such as clay, talc, and titanium dioxide; coloring materials, such as dyes and pigments; retention aids; fiber deflocculants; soaps and surfactants; defoamers; drainage aids; optical brighteners; pitch control chemicals; slimicides; and specialty chemicals, such as corrosion inhibitors, flameproofing agents, and anti-tarnish agents.

The basis weight of the polymer-reinforced paper of the present invention generally will be determined by the desired use. As a practical matter, the basis weight may be in a range of from about 35 to about 220 grams per square meter (gsm). However, lower or higher basis weights are contemplated as coming within the scope of the present invention.

The paper of the present invention in general is prepared in accordance with methods which are well known to those having ordinary skill in the art. Such methods typically include preparing an aqueous suspension of fibers; distributing the suspension on a forming wire; removing water from the distributed suspension to form a paper; and treating the paper with a latex binder. In general, the aqueous suspension is prepared by methods well known to those having ordinary skill in the art. Similarly, methods of distributing the suspension on a forming wire and removing water from the distributed suspension to form a paper also are well known to those having ordinary skill in the art.

Generally, the paper formed by removing water from the distributed aqueous suspension is dried prior to the treatment of the paper with the latex binder. Drying of the paper may be accomplished by any known means. Examples of known drying means include, by way of illustration only, convection ovens, radiant heat, infrared radiation, forced air ovens, and heated rolls or cans. Drying also includes air drying without the addition of heat energy, other than that present in the ambient environment.

Finally, paper-impregnating techniques are well known to those having ordinary skill in the art. Typically, a paper is exposed to an excess of the impregnating dispersion or latex, run through a nip, and dried. However, the impregnating dispersion may be applied by other methods, such as brushing, doctor blading, spraying, and direct and offset gravure printing or coating. The latex binder also may be added to the pulp stock or papermaking furnish before web formation.

The present invention is further described by the examples which follow. Such examples, however, are not to be construed as limiting in any way either the spirit or the scope of the present invention. In the examples, all parts are by weight, unless stated otherwise.

EXAMPLE 1–12

These examples describe the preparation of handsheets, some of which come within the scope of the present invention. The procedure for the preparation of the handsheets is described below.

Preparation of Pulp Slurry

A pulp suspension was prepared in a Valley Laboratory beater (Voith Laboratory Equipment, Ser. No. 109-F-1461, Voith Inc., Appleton, Wis.). Before loading the beater, the moisture content of the pulp was determined so as to load the beater with an amount equivalent to 360 g of dry pulp. The required amount of pulp was torn into small pieces and soaked overnight in tap water (the pulp was always torn to prevent further cutting of the fibers). The pulp then was processed in the beater for a time sufficient to give a desired tensile index; in these examples, the target tensile index was 40 newton meters per gram (N·m/g).

Preparation of Handsheets

A 3.4-liter volume of pulp slurry was removed from the Valley beater, diluted with approximately 12 liters of water, and mixed thoroughly. Exactly 1,000 ml of the diluted slurry was measured by means of a graduated cylinder and added to a 10-inch by 12-inch (25.4-cm by 30.5-cm) Williams handsheet mold (Williams Apparatus Company, Watertown, N.Y.) that was half-filled with water. The mold was completely filled with water, including water used to rinse the graduated cylinder. The water was drained from the mold and the pulp couched from the mold wire with two blotter papers, one on each side of the wet pulp sheet. An additional blotter paper was placed against each blotter paper already in place. The resulting assembly was pressed in a Williams Hydraulic Press (Williams Apparatus Company, Watertown, N.Y.) for five minutes at a pressure of 200 psig. The assembly was removed from the press and the top two blotter papers were discarded. The wet paper sheet was carefully removed from the underlying blotter papers and placed on a can steam dryer at 6 psig steam pressure (about 107° C.) with the wire side of the sheet next to the dryer surface. The sheet then was dried, marked with identifying indicia on the wire side, and weighed in a drying oven at 107° C. The percent consistency of the diluted pulp slurry from which the sheet was made was calculated by dividing the dry weight of the sheet by 1,000 and multiplying the quotient by 100. Based on the resulting percent consistency value, the volume of pulp slurry necessary to give a target sheet basis weight of 50 gsm was calculated. The calculated volume of diluted pulp was used to make all handsheets for impregnating with latex binder and subsequent testing.

Addition of Latex Binder (Latex Impregnation)

Each handsheet was labeled and weighed in the drying oven. Leaders of stiff grade paper were attached to each handsheet to aid in feeding the sheet through a saturator or size press. While the saturator employed was constructed in the laboratory., it was equivalent to the commercially available Model LW-1 Atlas Laboratory Wringer (Atlas Electric Devices Company, Chicago, Ill.). Each leader was butted against the edge of the handsheet and taped with masking tape. The latex binder was charged to an addition funnel having a stopcock. The funnel was suspended over the rolls of the saturator by means of a ring stand. The pressure on the saturator press rolls was adjusted by a mechanical arm which controlled the amount of binder pick-up. When the pressure was set, the stopcock of the addition funnel was opened. When the binder formed an even bead across the leader paper strip, the saturator was started, providing an even flooding of binder over the handsheet as it passed between the press rolls. After passing through the saturator, the leader was removed gently from the impregnated handsheet and the handsheet was dried on the can dryer. The dried handsheet then was weighed again in the drying oven. Binder percent pick-up was calculated as follows:

$$\text{Percent Pick-up}=100\times(\text{BDIW}-\text{BDHW})/\text{BDHW}$$

in which "BDIW" refers to the dry weight of the binder-impregnated handsheet and "BDHW" refers to the dry weight of the handsheet alone.

All pulps employed in these and the following examples were bleached kraft pulps. With one exception, the pulps were homogeneous pulps, i.e., pulps derived from a single species. The pulps are identified in Table 2. All hardwood pulp designations begin with the letter "H" and all softwood pulp designations begin with the letter "S."

TABLE 2

Summary of Pulps Employed in the Examples

| Designation | Pulp Source |
|---|---|
| H-EU | Eucalyptus |
| H-CEU | Curled Eucalyptus |
| H-ASP | Aspen |
| H-MAP | Maple |
| H-O/G | Oak/Gum |
| S-BSP | Black Spruce |
| S-CED | Cedar |
| S-SOP | Southern Pine |

In addition, a variety of the latex binders listed in Table 1 were employed: DL-219, a styrene-butadiene copolymer (Binder A) , Hycar® 26322, a polyacrylate (Binder B), and Rhoplex® B-15, a polyacrylate (Binder C).

The polymer-reinforced handsheets prepared as described above are summarized in Table 3. Each handsheet had a basis weight before impregnation of 50 gsm. In the table, "Tensile Index" refers to the tensile index in N·m/g of the handsheet before impregnation with binder, "Final Basis Weight" refers to the basis weight in gsm of the handsheet after impregnation, and "F/B Ratio" refers to the fiber/binder ratio on a dry weight basis. The strength characteristics of the polymer-reinforced papers are summarized in Table 4.

TABLE 3

Summary of Polymer-Reinforced Handsheets

| Example | Tensile Index | Final Basis Weight | Percent Pick-up | F/B Ratio | Fibers | Binder |
|---|---|---|---|---|---|---|
| 1 | 40 | 74 | 48 | 2/1.0 | H-EU | A |
| 2 | 39 | 73 | 46 | 2/0.9 | H-ASP | A |
| 3 | 38 | 74 | 48 | 2/1.0 | H-MAP | A |
| 4 | 41 | 74 | 48 | 2/1.0 | S-BSP | A |
| 5 | 40 | 74 | 48 | 2/1.0 | H-EU | B |
| 6 | 39 | 73 | 46 | 2/0.9 | H-ASP | B |
| 7 | 38 | 74 | 48 | 2/1.0 | H-MAP | B |
| 8 | 41 | 74 | 48 | 2/1.0 | S-BSP | B |
| 9 | 40 | 75 | 50 | 2/1.0 | H-EU | C |
| 10 | 39 | 80 | 60 | 2/1.2 | H-ASP | C |
| 11 | 38 | 80 | 60 | 2/1.2 | H-MAP | C |
| 12 | 41 | 80 | 60 | 2/1.2 | S-BSP | C |

TABLE 4

Strength Characteristics of Polymer-Reinforced Handsheets

| Example | TEA[a] | Percent Elong.[b] | Tear[c] |
|---|---|---|---|
| 1 | 180 | 6.7 | 883 |
| 2 | 106 | 4.1 | 598 |
| 3 | 124 | 5.1 | 638 |
| 4 | 154 | 4.8 | 746 |
| 5 | 337 | 24.2 | 912 |
| 6 | 240 | 13.4 | 540 |
| 7 | 185 | 10.6 | 647 |
| 8 | 454 | 22.6 | 884 |
| 9 | 248 | 7.7 | 697 |
| 10 | 116 | 3.8 | 490 |
| 11 | 197 | 6.5 | 549 |
| 12 | 166 | 5.4 | 706 |

[a]Tensile energy absorption in $J/m^2$.
[b]Percent elongation at break.
[c]Tear in millinewtons.

It is clear from Table 4 that the use of eucalyptus fibers resulted in polymer-reinforced handsheets or papers having significantly superior strength characteristics when compared with the other hardwood fibers studied. Moreover, except for the TEA result with Binder B, the strength characteristics of the polymer-reinforced papers prepared with eucalyptus fibers were essentially equal to or better than those obtained from the use of black spruce softwood fibers.

Figure 2:
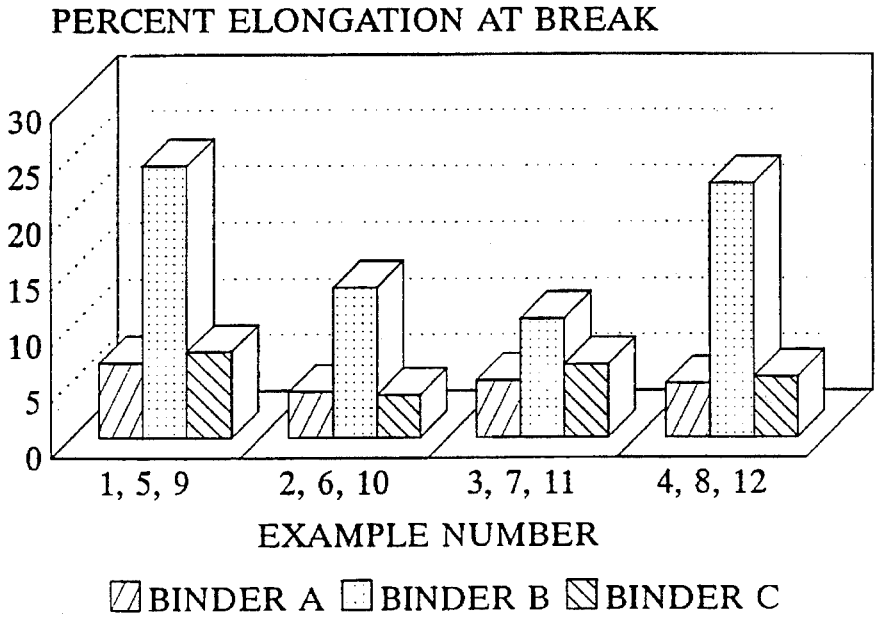
Figure 3:
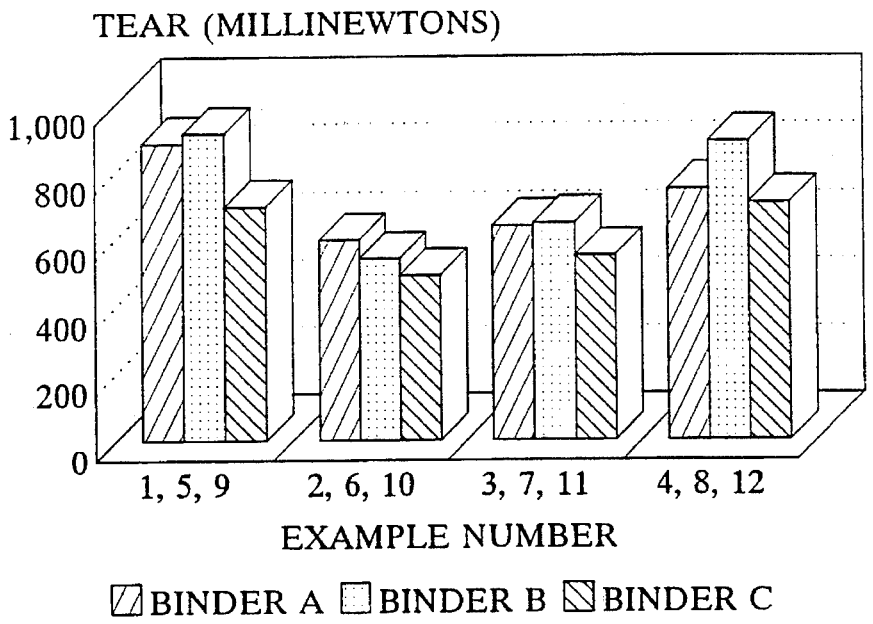

To better illustrate the superior strength characteristics resulting from the use of eucalyptus fibers, the data in Table 4 were plotted as bar graphs which are shown as FIGS. 1–3 for TEA, percent elongation at break, and tear, respectively. While strength characteristics vary significantly from binder to binder, the superiority of eucalyptus fibers (Examples 1, 5, and 9) over the other hardwood fibers tested is clear. It also is clear, contrary to conventional wisdom, that eucalyptus fibers generally are equal to or better than black spruce softwood fibers.

EXAMPLES 13–20

The procedure of Examples 1–12 was repeated, except that the target base tensile index was in the 25–40 N·m/g range, the target sheet basis weight was gsm, and Binder C was the only binder employed. The polymer-reinforced handsheets are summarized in Table 5 and the strength characteristics of the polymer-reinforced papers are summarized in Table 6.

TABLE 5

Summary of Polymer-Reinforced Handsheets

| Example | Tensile Index | Final Basis Weight | Percent Pick-up | F/B Ratio | Fibers | Binder |
|---|---|---|---|---|---|---|
| 13 | 39 | 220 | 64 | 2/1.2 | H-EU | C |
| 14 | 26 | 201 | 50 | 2/1.0 | H-CEU | C |
| 15 | 39 | 214 | 60 | 2/1.2 | H-ASP | C |
| 16 | 38 | 214 | 60 | 2/1.2 | H-MAP | C |
| 17 | 30 | 204 | 52 | 2/1.0 | H-O/G | C |
| 18 | 41 | 214 | 60 | 2/1.2 | S-BSP | C |
| 19 | 37 | 197 | 47 | 2/0.9 | S-CED | C |
| 20 | 24 | 202 | 51 | 2/1.0 | S-SOP | C |

TABLE 6

Strength Characteristics of Polymer-Reinforced Handsheets

| Example | TEA[a] | Percent Elong.[b] | Tear[c] |
|---|---|---|---|
| 13 | 868 | 9.3 | 21.8 |
| 14 | 1120 | 15.3 | 21.3 |
| 15 | 310 | 3.8 | 13.1 |
| 16 | 528 | 6.5 | 14.7 |
| 17 | 452 | 6.7 | 17.1 |
| 18 | 471 | 5.4 | 18.9 |
| 19 | 492 | 7.2 | 17.1 |
| 20 | 415 | 6.7 | 25.5 |

[a]Tensile energy absorption in $J/m^2$.
[b]Percent elongation at break.
[c]Tear in millinewtons.

Although the base tensile indexes and final basis weights of the polymer-reinforced handsheets of Examples 13–20 varied more than those of Examples 1–12, it is evident from Table 6 that the use of eucalyptus fibers resulted in polymer-reinforced handsheets or papers having significantly superior strength characteristics when compared with the other hardwood fibers studied. The significant improvement in TEA and percent elongation resulting from the use of curled eucalyptus fibers is particularly apparent. In addition, except for the tear result, the strength characteristics of the polymer-reinforced papers prepared with eucalyptus fibers were essentially equal or better than those obtained from the use of the three softwood fibers studied.

Figure 4:
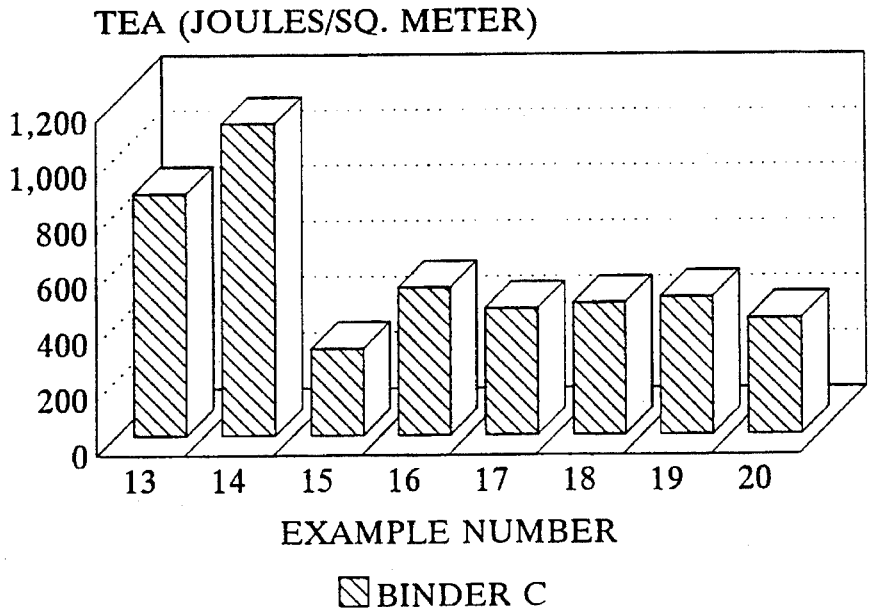
Figure 5:
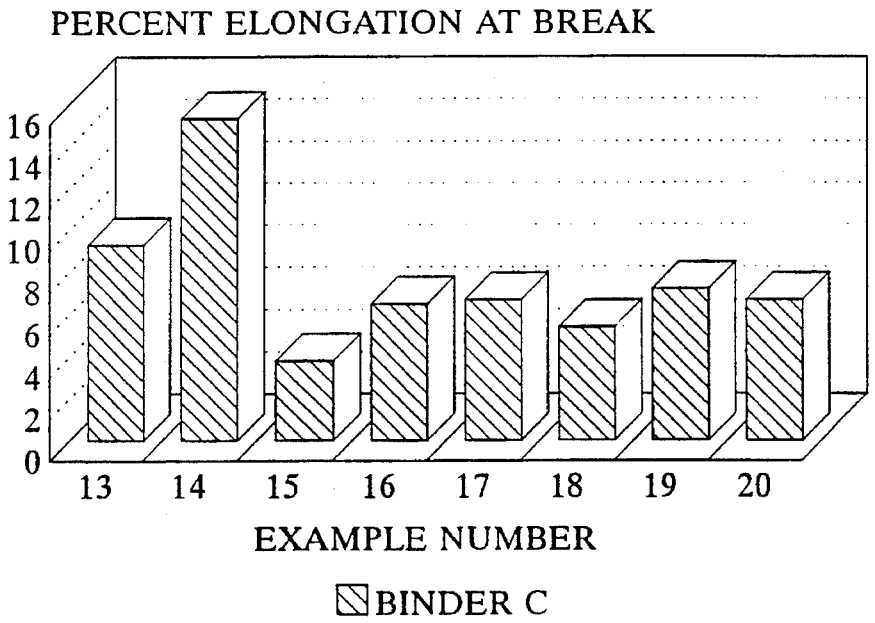
Figure 6:
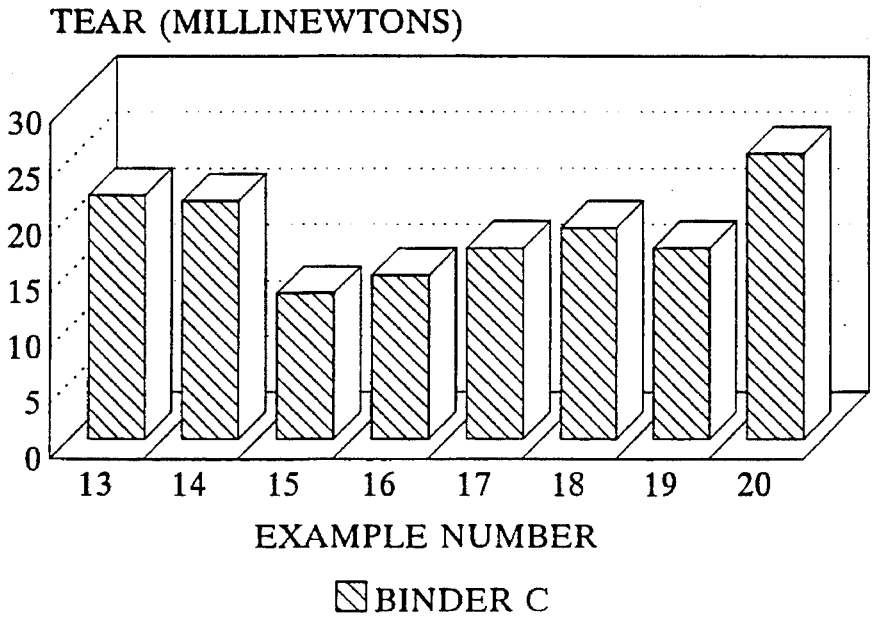

To better illustrate the superior strength characteristics resulting from the use of eucalyptus fibers, the data in Table 6 were plotted as bar graphs which are shown as FIGS. 4–6 for TEA, percent elongation at break, and tear, respectively. The superiority of eucalyptus fibers (Examples 13 and 14) over the other hardwood fibers tested (Examples 15, 16, and 17) is apparent. The figures also demonstrate that eucalyptus fibers generally are equal to or better than softwood fibers (Examples 18, 19, and 20).

EXAMPLES 21–40

The procedure of Examples 1–12 was repeated with only Binder B. In these examples, the target base tensile index was 38 N.m/g and the target sheet basis weight was 50 gsm. The polymer-reinforced handsheets and tear results are summarized in Table 7.

TABLE 7

Summary of Binder B-Reinforced Handsheets and Tear Results

| Example | Fibers | Percent Pick-up | Tear[a] |
|---|---|---|---|
| 21 | H-EU | 0 | 334 |
| 22 | H-EU | 24 | 873 |
| 23 | H-EU | 33 | 932 |
| 24 | H-EU | 48 | 912 |
| 25 | H-EU | 68 | 922 |
| 26 | H-ASP | 0 | 461 |
| 27 | H-ASP | 22 | 510 |
| 28 | H-ASP | 30 | 520 |
| 29 | H-ASP | 45 | 540 |
| 30 | H-ASP | 60 | 569 |
| 31 | H-MAP | 0 | 284 |
| 32 | H-MAP | 22 | 589 |
| 33 | H-MAP | 33 | 628 |
| 34 | H-MAP | 48 | 647 |
| 35 | H-MAP | 59 | 677 |
| 36 | S-BSP | 0 | 1040 |
| 37 | S-BSP | 23 | 1118 |
| 38 | S-BSP | 33 | 991 |
| 39 | S-BSP | 48 | 834 |
| 40 | S-BSP | 62 | 814 |

[c]Tear in millinewtons.

Figure 7:
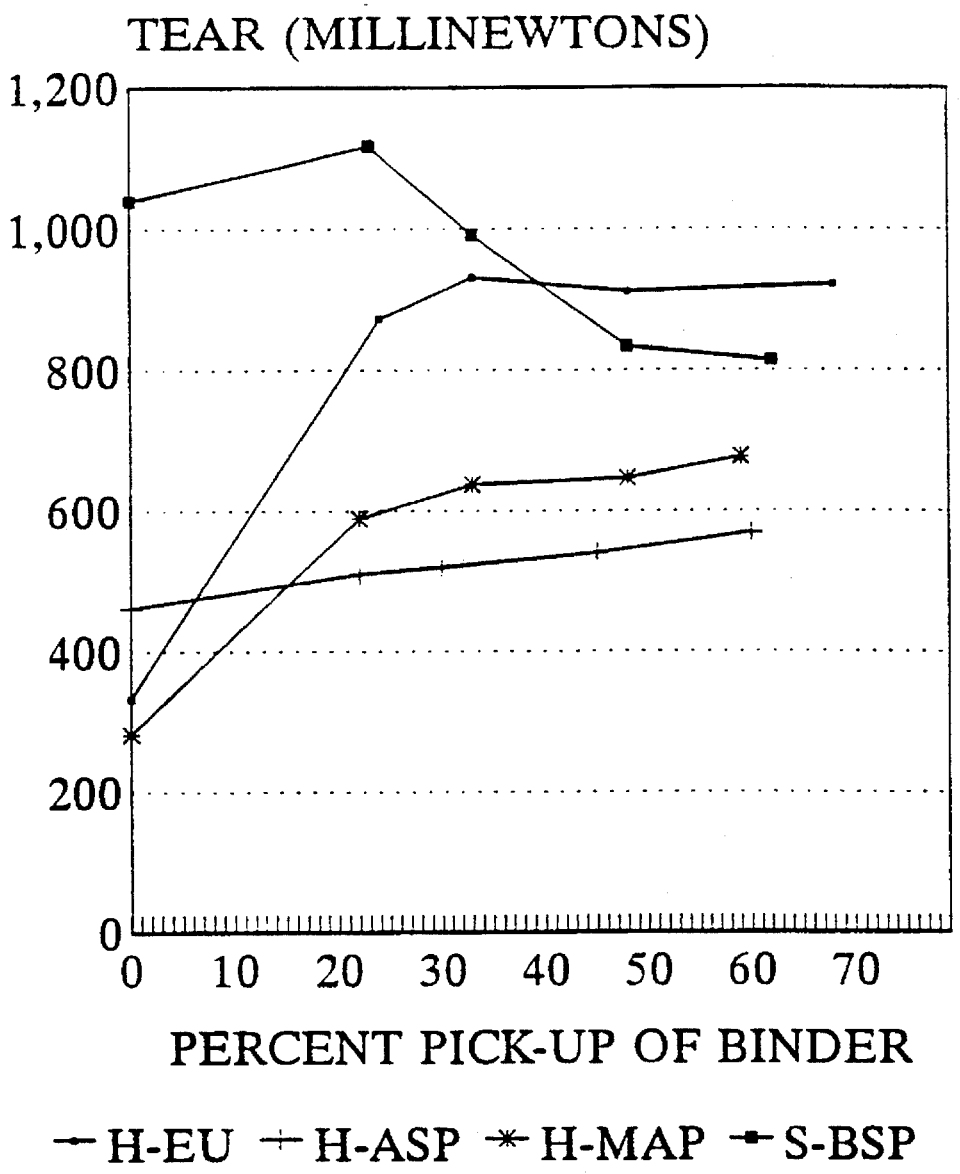
FIG. 7 is a plot of tear versus percent pick-up of binder for polymer-reinforced papers made from four different types of fibers.

In order to better visualize the results summarized in Table 7, the data in the table were plotted as tear results versus percent binder pick-up; the plots are shown in FIG. 7. The tear results obtained with softwood fibers were higher with either no polymer reinforcement or with low (no more than about 30 percent) levels of binder pick-up; at binder levels greater than about 30 percent, tear values decreased significantly. All three hardwoods studied gave relatively low tear results in the absence of polymer reinforcement. While the tear values for all three hardwoods studied increased with increasing levels of polymer reinforcement, only eucalyptus fibers gave tear values which eventually exceed the tear values achieved with the softwood fibers studied.

EXAMPLES 41–51

This final set of examples is presented to demonstrate the advantages which accrue from the use of eucalyptus fibers in mixed or heterogeneous fiber polymer-reinforced papers. Again, the procedure of Examples 1–12 was followed. The binders involved included Binder C plus two other binders from Table 1: Hycar® 26469, a polyacrylate (Binder D), and Hycar® 1572, a nitrile rubber (Binder E). The fibers employed in each example are given in Table 8 (all percents are percent by weight, based on the dry weight of the fibers). The polymer-reinforced handsheets are summarized in Table 9 and the strength characteristics of the polymer-reinforced papers are summarized in Table 10.

TABLE 8

Fibers Employed in Examples 41–51

| Example | Fibers Employed | |
|---|---|---|
| | Type | Percent |
| 41 | S-BSP | 35 |
| | S-SOP | 34 |
| | H-MAP | 31 |
| 42 | S-BSP | 25 |
| | H-EU | 75 |

TABLE 8-continued

| Fibers Employed in Examples 41–51 | | |
|---|---|---|
| | Fibers Employed | |
| Example | Type | Percent |
| 43 | S-BSP | 100 |
| 44 | S-BSP | 25 |
| | H-EU | 75 |
| 45 | S-BSP | 90 |
| | H-ASP | 10 |
| 46 | S-BSP | 50 |
| | H-EU | 50 |
| 47 | S-BSP | 100 |
| 48 | S-BSP | 25 |
| | H-EU | 75 |
| 49 | S-BSP | 21 |
| | H-EU | 64 |
| | SYN[a] | 15 |
| 50 | S-BSP | 70 |
| | H-ASP | 30 |
| 51 | S-BSP | 70 |
| | H-EU | 30 |

[a]Synthetic fibers - polyester fibers having a denier of 6 grams per 9,000 meters and an average length of 13 mm.

TABLE 9

| Summary of Polymer-Reinforced Handsheets | | | | | | |
|---|---|---|---|---|---|---|
| Example | Tensile Index | Initial Basis Weight | Final Basis Weight | Percent Pick-up | F/B Ratio | Binder |
| 41 | 29 | 134 | 204 | 52 | 2/1.0 | C |
| 42 | 34 | 134 | 208 | 55 | 2/1.0 | C |
| 43 | 31 | 71 | 107 | 51 | 2/1.0 | C |
| 44 | 32 | 71 | 110 | 55 | 2/1.2 | C |
| 45 | 34 | 62 | 91 | 47 | 2/0.9 | C |
| 46 | 30 | 62 | 94 | 52 | 2/1.0 | C |
| 47 | 30 | 75 | 112 | 49 | 2/1.0 | D |
| 48 | 32 | 75 | 112 | 49 | 2/1.0 | D |
| 49 | 24 | 75 | 112 | 49 | 2/1.0 | D |
| 50 | 32 | 50 | 73 | 32 | 2/0.9 | E |
| 51 | 26 | 50 | 76 | 52 | 2/1.0 | E |

TABLE 10

| Strength Characteristics of Polymer-Reinforced Handsheets | | | |
|---|---|---|---|
| Example | TEA[a] | Percent Elong.[b] | Tear[c] |
| 41[d] | 504 | 8.7 | 25.5 |
| 42 | 857 | 10.2 | 29.0 |
| 43 | 249 | 7.0 | 9.2 |
| 44 | 345 | 9.6 | 10.8 |
| 45 | 203 | 6.3 | 8.0 |
| 46 | 260 | 7.4 | 9.5 |
| 47 | 261 | 7.3 | 10.2 |
| 48 | 345 | 8.0 | 12.2 |
| 49 | 286 | 7.6 | 23.5 |
| 50 | 165 | 5.7 | 7.6 |
| 51 | 166 | 6.3 | 8.9 |

[a]Tensile energy absorption in $J/m^2$.
[b]Percent elongation at break.
[c]Tear in millinewtons $\times 10^{-2}$.
[d]Data from a mill run, rather than from handsheets; listed values are averages of machine and cross direction results.

From an examination of Tables 8 and 9, it will be apparent that Examples 41–51 consist of five groups of examples, with each set having a control, as shown in Table 11.

TABLE 11

| Grouping of Examples | | |
|---|---|---|
| Group | Examples in Group | Control Example |
| 1 | 41 and 42 | 41 |
| 2 | 43 and 44 | 43 |
| 3 | 45 and 46 | 45 |
| 4 | 47–49 | 47 |
| 5 | 50 and 51 | 50 |

In order to conserve space, the data of Table 10 were not plotted. Rather, the improvement obtained from the use of eucalyptus fibers as a percent improvement (PI) over the corresponding control value was calculated as follows:

$$PI=100\times(\text{H-EU value}-\text{control value})/\text{control value}$$

in which "H-EU value" is the value resulting from the inclusion of eucalyptus fibers in the handsheet or paper. The percent improvement values calculated for the non-control Examples are presented in Table 12.

TABLE 12

| Percent Improvement Values | | | | |
|---|---|---|---|---|
| | | Percent Improvement | | |
| Group | Example | TEA[a] | Elong.[b] | Tear[c] |
| 1 | 42 | 70 | 17 | 14 |
| 2 | 44 | 39 | 37 | 17 |
| 3 | 46 | 28 | 17 | 16 |
| 4 | 48 | 32 | 10 | 20 |
| | 49 | 10 | 4 | 130 |
| 5 | 51 | 1 | 11 | 17 |

[a]Tensile energy absorption.
[b]Percent elongation at break.
[c]Tear.

In one instance (the percent improvement for TEA in Example 51), and possibly in one other (the percent improvement for percent elongation in Example 49) the percent improvement value suggests that, for the particular test, essentially the same value was obtained as for the control. In all other instances, however, it is evident that the inclusion of at least about 30 percent eucalyptus fibers results in improved strength characteristics for polymer-reinforced papers. Moreover, such improvements are independent of the latex binder employed.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. An improved-strength, polymer-reinforced paper comprising:

fibers, of which from about 60 to about 80 percent on a dry weight basis are eucalyptus fibers and from about 5 to about 25 percent on a dry weight basis are synthetic fibers; and from about 15 to about 60 percent on a dry weight basis, based on the dry weight of the fibers, of a latex binder.

2. The polymer-reinforced paper of claim 1, in which the synthetic fibers are polyester fibers.

3. An improved-strength, polymer-reinforced paper comprising:

fibers, wherein the fibers comprise from about 40 to about 75 percent on a dry weight basis of eucalyptus fibers, from about 59 to about 1 percent on a dry weight basis of non-eucalyptus cellulosic fibers, and from about 59 to about 1 percent on a dry weight basis of synthetic fibers; and from about 15 to about 60 percent on a dry weight basis, based on the dry weight of the fibers, of a latex binder.

4. The polymer-reinforced paper of claim 3, in which the non-eucalyptus cellulosic fibers comprise softwood fibers.

5. The polymer-reinforced paper of claim 3, in which the non-eucalyptus cellulosic fibers comprise hardwood fibers other than eucalyptus fibers.

6. The polymer-reinforced paper of claim 3, in which the non-eucalyptus cellulosic fibers comprise a mixture of softwood fibers and hardwood fibers other than eucalyptus fibers.

7. The polymer-reinforced paper of claim 3, in which the synthetic fibers are polyester fibers.

8. The polymer-reinforced paper of claim 1, in which the paper has a basis weight of from about 35 to about 220 grams per square meter.

9. The polymer-reinforced paper of claim 1, in which the eucalyptus fibers are curled.

10. The polymer-reinforced paper of claim 3, in which the paper has a basis weight of from about 35 to about 220 grams per square meter.

11. The polymer-reinforced paper of claim 3, in which the eucalyptus fibers are curled.

* * * * *